US005154472A

United States Patent [19]

Kaufman

[11] Patent Number: 5,154,472

[45] Date of Patent: Oct. 13, 1992

[54] FOLDING CHAIR WITH CONTINUOUSLY VARIABLE SELF-BALANCED TILTING ACTION

[76] Inventor: Yaacov Kaufman, 17 Alexander Yanai Street, Tel Aviv, Italy

[21] Appl. No.: 714,655

[22] Filed: Jun. 13, 1991

[30] Foreign Application Priority Data

Jun. 15, 1990 [IL] Israel ..... 094742
May 30, 1991 [IT] Italy ..... 001481 A/91

[51] Int. Cl.[5] ..... A47C 4/00

[52] U.S. Cl. ..... 297/23; 297/50; 297/316; 297/317

[58] Field of Search ..... 297/22, 23, 29, 46, 297/50, 58, 316, 317, 320, 343

[56] References Cited

U.S. PATENT DOCUMENTS 780,010 1/1905 Mettler ..... 297/50
780,771 1/1905 Axelrad ..... 297/343
2,216,316 10/1940 Karish ..... 297/50
4,504,090 3/1985 Goldman ..... 297/317 X
4,861,106 8/1989 Sondergeld ..... 297/316

FOREIGN PATENT DOCUMENTS 78584 7/1952 Denmark ..... 297/317
164790 10/1933 Switzerland ..... 297/320
284340 1/1950 Switzerland ..... 297/343

*Primary Examiner*—Laurie K. Cranmer
*Attorney, Agent, or Firm*—Herbert Dubno; Yuri Kateshov

[57] ABSTRACT

A chair having a seating unit and two pairs of legs made slidably integral by couplings attached to the seating unit and designed to engage the relevant inserts located in such first pair of legs, which are made to slide in relation to the second pair of legs by further couplings located in further inserts provided on the second pair of legs, so as the couplings are designed to allow substantially continuous tilt adjustment of the seat and of the backrest relative to the seat, as a result of the relevant pushing action exerted by the user while assuming various positions that are balanced by the push up action.

9 Claims, 3 Drawing Sheets

FOLDING CHAIR WITH CONTINUOUSLY VARIABLE SELF-BALANCED TILTING ACTION

FIELD OF THE INVENTION

This invention relates to a folding chair especially intended for office use and designed for continuous tilt adjustment of the seat and backrest to assume continuously stable settings automatically balanced by the same action which has brought about such adjustment.

BACKGROUND OF THE INVENTION

It is known that there is an increasing need to alter the setting of chair, armchair and similar seats in relation to the various positions assumed by the user throughout the day. In the office environment particularly, following the widespread introduction of computer and word processing systems on desks, it is necessary to provide a chair enabling a comfortable and ergonomically correct position to be achieved both when writing normally at a table or desk and when using a computer keyboard. The keyboard usually is placed in a lower position relative to the desk top so that it is necessary to provide a slight backward tilt to the so-called active rest position.

OBJECTS OF THE INVENTION

It is, therefore, the principal object of the invention to provide a chair capable of allowing forward swivelling of the seating unit as well as controlling swivel of the backrest relative to the seat so that the user may assume either a more favorable position for writing and/or typing or a slight backward tilt to the rest position.

A further object of this invention is to provide an improved chair capable of allowing substantially continuous adjustment to the setting of the seat and backrest as a result of the different positions at various times.

Still another object of the invention is to provide a chair having extremely compact dimensions and comprising of a small number of parts capable of being easily assembled and dismantled and easily folded when not in use in order to reduce its overall dimensions and facilitate both storage in a folded position by the user and transportation by the manufacturer.

SUMMARY OF THE INVENTION

The objects are obtained according to the present invention, which provides for a chair of a type comprising a seating unit consisting of a seat, a backrest and of two pairs of legs. The seat and backrest are made rotationally integral with one another by means of hinges while pairs of legs and the seating unit are made slidingly integral with one another by means of couplings attached to the seating unit and designed to engage the relevant inserts located at the legs. The latter, in turn, slide in relation to one another by further couplings integral with the legs and designed to engage further inserts located in such legs. Means for guidance is provided for the sliding of the legs in relation to the seat. This means is located on a single axis and designed to allow substantially continuous tilting of both the seat and the backrest relative to the seat. As a result of the pushing action exerted by the user the opening and closing of the chair is significantly facilitated.

More particularly, provision is made for such coupling facilities to be substantially comprised of pins integral with the backrest and the seat and projecting therefrom in a substantially horizontal direction. At least one pair of such pins constitude also the swivel pin of the hinge, the upper arm of which has its end rotationally integral with the other pair of pins.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
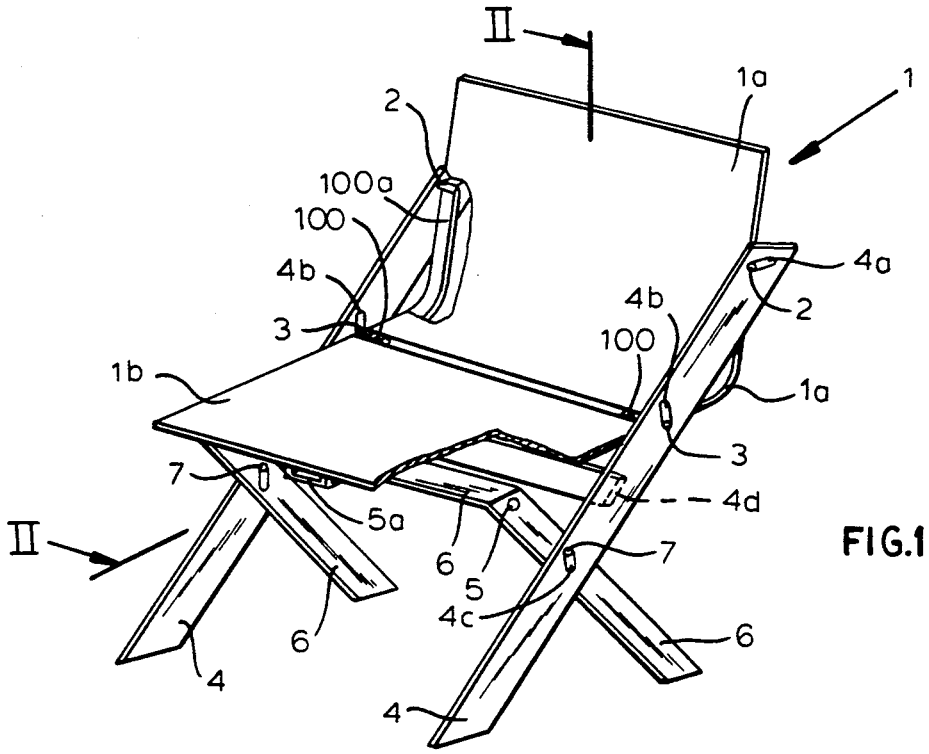
FIG. 1 is a diagrammatic perspective view in oblique projection of the chair according to the invention.

As shown in FIG. 1, the chair according to the invention is substantially comprised of a seating unit 1 consisting of a slablike member folded along a curved line 1*c* to provide a substantially vertical backrest 1*a* and a substantially horizontal plane of seat 1*b*. Such seat 1*b* and backrest 1*a* are made rotationally integral with one another by means of a pair of hinges 100 consisting of two arms 100*a* and 100*b* respectively attached to backrest 1*a* and seat 1*b*.

More particularly, the upper end of each arm 100*a* ends in a circular insert containing a pin 2 partly extending from the edge of backrest 1*a*, while the swivel pin 3 of hinge 100 protrudes from seat 1*b*. The swivel pin 3, in turn, extends from the respective hinge 100.

Such pins 2 and 3 are designed to be inserted in a known manner into the appropriate slots 4*a* and 4*b* of a first pair of legs 4, located at an angle relative to seating unit 1, so that the pair of legs which are thus made is mounted slidingly on both backrest 1*a* and seat 1*b*. The legs 4 are then connected together by a crossbar 4*d* to form a substantially H-shaped first frame.

Slots 4*a* and 4*b* are furthermore respectively located as follows: the first slat 4*a* is substantially inclined upward and rearward, and the second slat 4*b* is substantially vertical.

Figure 2:
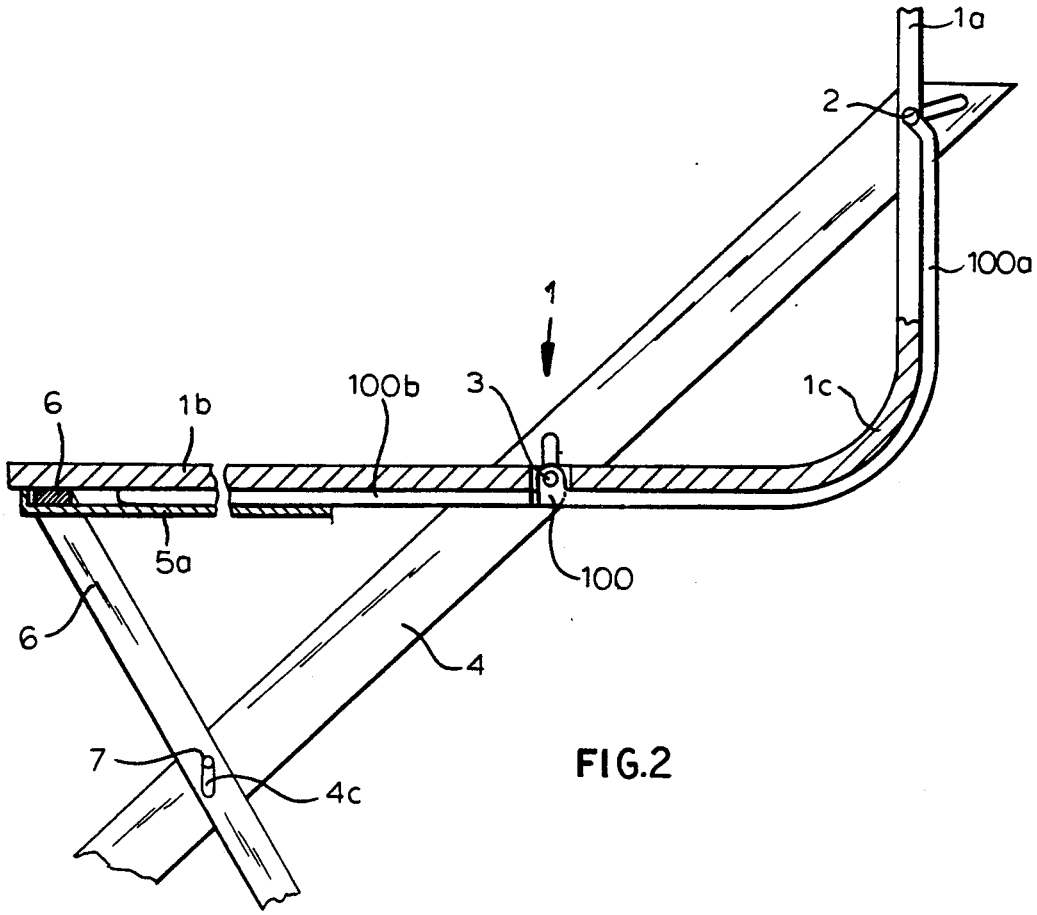
FIG. 2 is a partial diagrammatic section on plane II—II in FIG. 1.

The lower surface of the front end of seat 1*b* is also supported on a crossbar 6' for the attachment of a further pair of legs 6, the assembly of which forms a substantially "inverted U"-shaped second frame, linked in a sliding manner to seat 1*b* by means of a rail 5*a* as seen in FIG. 2 operatively connected with the lower surface of seat 1*b* and in which slides crossbar 6'.

Legs 6 of the second pair are likewise linked in a sliding manner to the first pair of legs 4 by means of pins 7 inserted in a known manner into slots 4*c* which are provided in appropriate positions on legs 4.

As is apparent from FIGS. 1 and 2, the chair as used under normal conditions has its seat 1*b* located substantially horizontal, its backrest 1*a* substantially vertical and pins 2, 3 and 7 positioned respectively at the inner, lower and upper ends in slots 4*a*, 4*b* and 4*c*.

When the user wishes to change his position he shifts his own center of gravity so as to exert, with his own weight, a pushing action on the front end of seat 1*b*, thus bringing about a corresponding action on pins 7 which slide towards the lower end of slots 4*c*, while swivel pins 3, constituting the neutral axis, maintain their position relative to the lower end of slots 4*b*. On the other hand, should the user wish to assume an active rest position with the backrest tilted rearward, it will be sufficient to exert pushing action on backrest 1*a* which, rotating on pins 3 of hinge 100, will tilt rearward to shift pins 2 from the front end setting to the rear end setting of slats 4*a* and pins 3 themselves to the upper end, setting of slot 4*b*.

Figure 3:
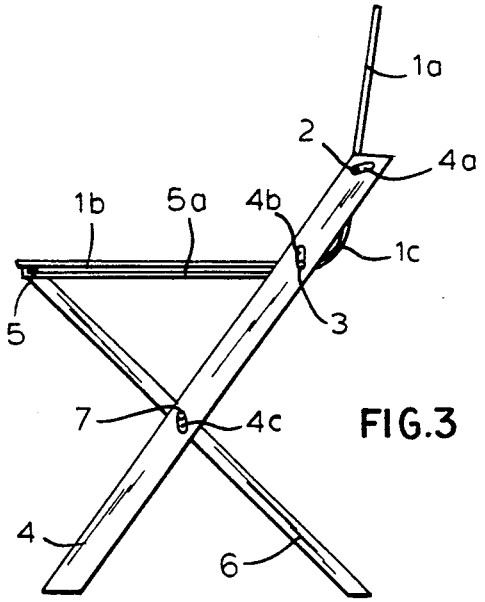
FIG. 3 is a side elevational view of the chair according to FIG. 1.
Figure 4A:
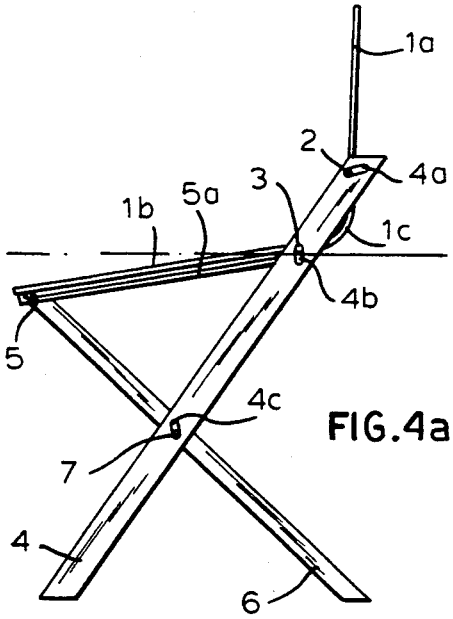
FIG. 4*a* is a side elevational view according to FIG. 1 of the chair tilted forward.
Figure 4B:
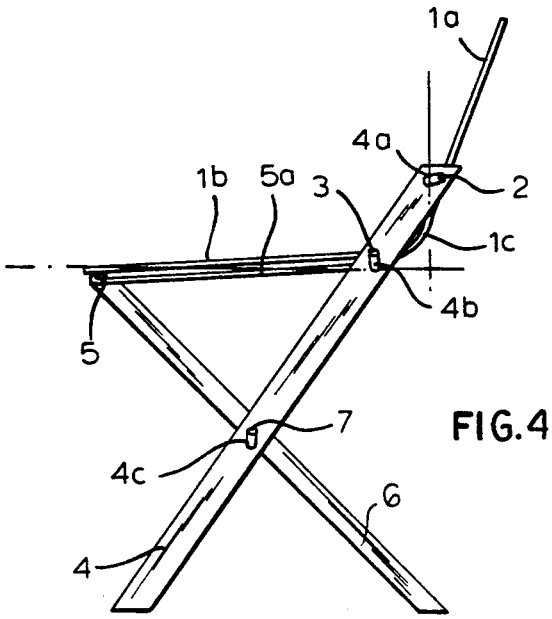
FIG. 4*b* is a side elevational view according to FIG. 1 with the backrest tilted rearward.
Figure 5:
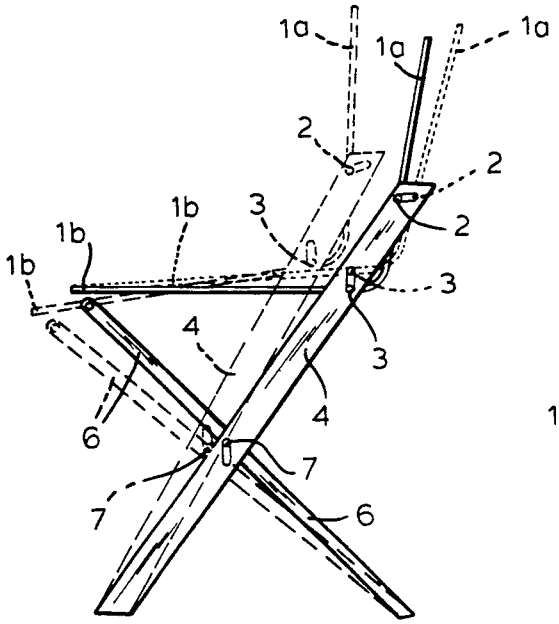
FIG. 5 is a diagrammatic side elevational view of the chair according to FIG. 1; with the various movements depicted by broken lines and dotted lines for seat and backrest tilt respectively.
Figure 6:
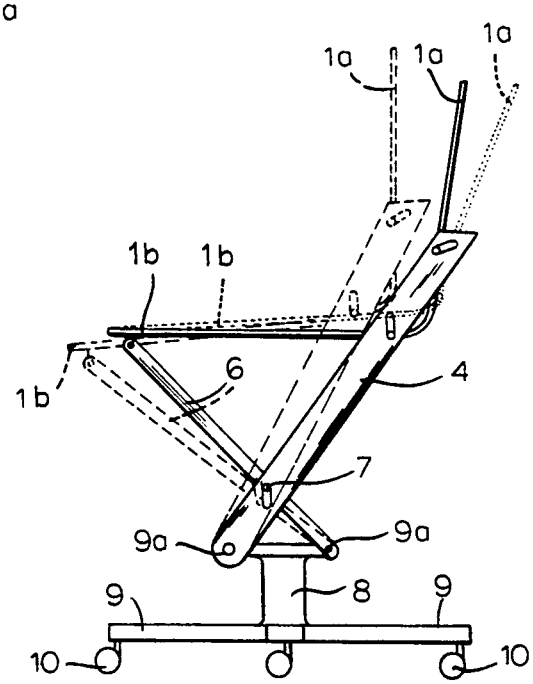
FIG. 6 is a side elevational view of the chair mounted on wheels.

For a better understanding, FIGS. 3, 5 shows the various positions which may be assumed by the chair, namely: normal position with seat 1*b* horizontal and backrest 1*a* vertical, shown in FIG. 3 and indicated by a continuous line in FIGS. 5 and 6; working position with seat 1*b* tilted forward but no change in the relative position of backrest 1*a* and seat 1*b*, indicated by a broken line; rest position with seat 1*b* horizontal and backrest 1*a* tilted rearward, indicated by a dotted line. It is furthermore apparent that pins 2, 3 and 7 may be positioned, within the relevant slots 4*a*, 4*b*, 4*c*, in any intermediate setting between the two end settings, as a result of the pushing action exerted by the user; all the settings are stable since they are balanced by the user's own weight and by the position assumed by his center of gravity.

The chair according to the invention may also be folded after use, to be placed, for example, in a less conspicuous position or in a cupboard; in order to reduce its overall dimensions seat 1*b* is swivelled clockwise, whereupon it moves upward and causes pins 5 to slide within guides 5*a* toward backrest 1*a*, thus causing legs 6 to swivel on pins 7 and to close in a position parallel to legs 4, whilst seat 1*b* is folded onto the backrest thus substantially reducing the chair to a parallelepiped the thickness of which is substantially contained within the width of legs 4.

FIG. 6 also shows a first alternative version of the chair according to the invention in which the entire supporting structure is mounted on a column 8 which in turn is mounted on a star-like base (9) fitted with castors 10. In this case the lower ends of legs 4 and 6 are, in a known manner not described herein, made integral with column 8 by means of hinges 9*a* to enable backrest 1*a* and seat 1*b* to assume the same various positions previously described.

Figure 7:
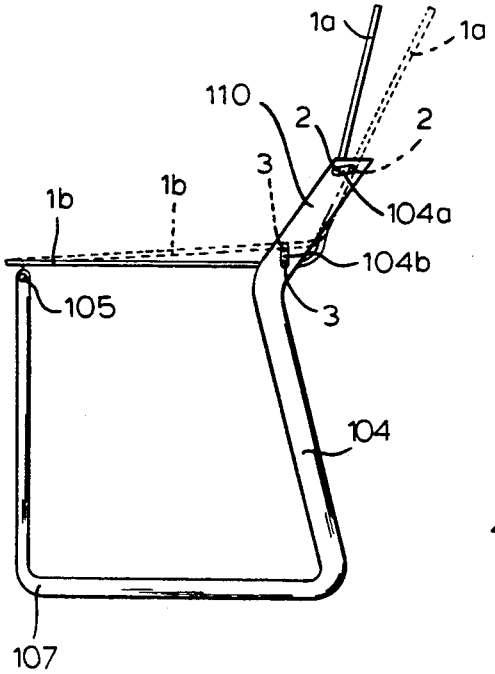
FIG. 7 is a side elevational view of another embodiment according to the invention.

FIG. 7 shows, in turn, a second alternative version of the chair according to the invention in which legs 4 and 6 are replaced by a frame 104, substantially of channel section, with a first end still hinged at 105 and a second end extended upward and rearward to form an arm 110, which still includes slots 104*a* and 104*b* between which slide pins 2 and 3. In this case it is possible to adjust both the rake of backrest 1*a* rearward and, in a limited manner, the forward tilt of seat 1*b* by elastic deformation around link 107, the movement of the pins within the slots being entirely similar to that previously described for the chair in FIG. 1. The chair in FIG. 7 may also be provided with two flat members constituting the sides of an armchair still made connected with seating unit 1 by means of pins 2, 3 and slots 4*a*, 4*b*, the operation required for tilt adjustment remains unchanged.

Figure 8:
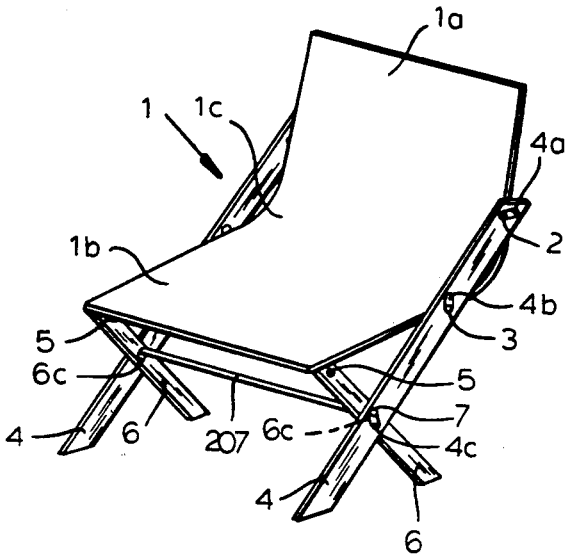
FIG. 8 is a perspective view of still another embodiment according to the present invention.

FIG. 8 shows a further alternative version of the chair in which backrest 1*a* and seat 1*b* form a one-piece shell of suitable section to enable backrest 1*a* to swivel relative to seat 1*b*. In this case the chair can no longer be folded but, seat adjusting movements can still be carried out as shown in FIG. 5. It is therefore apparent that the chair according to the invention makes it possible to obtain different settings of the seat and of the backrest as a result of the different positions assumed by the user and that such settings, which can be substantially adjusted in a continuous manner, are all substantially stable because they are balanced by the action exerted by the actual user.

Many alternatives may be introduced in the technical development of the constructional details of the chair according to the invention without thereby departing from the scope thereof as far as its general features are concerned. In particular, it will be possible to altar the length and arrangement of the various slots in order to change the extent to which the seat and backrest can be moved from the rest position and/or the higher or lower sliding friction of the pins in the slots determining the dynamic characteristics of movement, i.e. the greater or lesser ability of the chair to adjust the settings of the seat and backrest.

I claim:

1. A chair comprising:

a support including:

a first pair of elongated legs spaced from one another, said legs being formed with respective top portions;

a second pair of elongated legs transverse to said first pair of legs and formed with respective top and bottom sides, said top portions of said legs of the first pair extending above said top sides of said legs of said second pair;

a seat unit mounted on said support and comprising:

a seat extending generally in a horizontal plane in a normal position of said seat unit and formed with a top surface and a bottom surface, said bottom surface being operatively connected with said top sides of said second pair of legs;

a back extending upwardly from said seat and lying generally in a vertical plane in said normal position, said back and said seat being operatively connected with and movable relative to one another;

a first pair of elongated slots each formed on a respective top portion of said first pair of legs and extending transverse to a vertical;

a second pair of elongated slots each formed on a respective leg of said first pair of legs below the respective slot of said first pair of slots and extending generally parallel to a vertical;

a third pair of elongated slots each formed on the respective leg of said first pair below the respective slot of said second pair of slots and extending generally parallel to a vertical;

first coupling means for slidably connecting said back with said first slots guiding said back reawardly from said normal position toward a rest position of said seat unit upon leaning back of a user;

second coupling means for slidably mounting said seat on said second pair of slots guiding the seat upwardly toward the rest position of said seat unit; and third coupling means for slidably mounting said second pair of legs on said third pair of slots, a front of the seat being movable angularly downwardly from said normal position of said seat unit toward a working position of the seat unit upon movement of said bottom sides of said second pair of legs reawardly and displacement of a center of gravity of the user toward said front of said seat.

2. The chair defined in claim 1, further comprising mounting means for coupling said seat and back flexibly with one another, said mounting means being a pair of hinges, each of said hinges being formed with respective arms respectively connected with said back and seat of said seat unit.

3. The chair defined in claim 1 wherein each of said first, second and third coupling means includes respective pins extending along respective mutually parallel pivotal horizontal axes and being received by the respective first, second and third pairs of slots.

4. The chair defined in claim 1 wherein said top sides of the second pair of legs are bridged by a cross bar operatively connected with said bottom surface of said seat.

5. The chair defined in claim 1 wherein said seat unit is a one-piece shell made of a flexible material.

6. The chair defined in claim 5 wherein said first and second pair of legs are bridged by a third pair of legs spaced downwardly from the seat, so that first, second and third pair of legs constitute a frame formed with respective channel-like portions.

7. The chair defined with in claim 1, further comprises:

a base provided with a plurality of casters;

a vertical column extending upwardly from said base; and hinge means for pivotally mounting said first and second pair of legs on said base.

8. The chair defined in claim 1, further comprises guiding means mounted on said bottom surface of the seat for sliding said top sides of said second pair of legs therealong so that said chair can be completely folded.

9. A chair comprising:

a support including:

a first pair of legs spaced from one another and lying in parallel planes, each of said legs being formed with a respective rear portion extending rearwardly upwardly with respect to a vertical, and a second pair of legs each formed with respective front portions, said rear portions of the first pair of legs extending above said front portions of said legs of the second pair;

a seat unit mounted on said support and comprising:

a seat extending generally in a horizontal plane in a normal position of said seat unit and formed with a front operatively connected with said front portions of said second pair of legs; and a back extending upwardly from said seat and lying generally in a vertical plane in said normal position, said back and said seat being operatively connected with and movable relative to one another;

a first pair of elongated slots formed on the respective rear portions of each of said first pair of legs and extending transverse to a vertical;

a second pair of elongated slots formed on each of said legs of said first pair below the respective slot of said first pair and extending generally parallel to a vertical;

first coupling means for slidably mounting said back in said first pair of slots, said back being movable outwardly toward a rest position of said seat unit upon displacement of a centre of gravity of a user toward said rear portion of said first pair of legs; and second coupling means for slidably connecting said seat with said second pair of slots, said seat being guided upwardly along said slots of said second pair toward said rest position upon displacement of the centre of gravity of the user.

* * * * *